US005771910A

United States Patent [19]

Kluttz

[11] Patent Number: 5,771,910

[45] Date of Patent: Jun. 30, 1998

[54] COLLAPSIBLE SECTIONAL LOFSTRAND-TYPE CRUTCH

[76] Inventor: Sherri L. Kluttz, 4105 Crabapple La., Greensboro, N.C. 27405

[21] Appl. No.: 899,477

[22] Filed: Jul. 24, 1997

Related U.S. Application Data

[60] Provisional application No. 60/002,897 Aug. 1, 1996.

[51] Int. Cl.[6] ..... A61H 3/02

[52] U.S. Cl. ..... 135/68; 135/72

[58] Field of Search ..... 135/66, 68, 69, 135/71, 72, 76, 75

[56] References Cited

U.S. PATENT DOCUMENTS

| | | | |
|---|---|---|---|
| 888,468 | 5/1908 | Casale . | |
| 976,638 | 11/1910 | Corey . | |
| 2,453,632 | 11/1948 | Lofstrand, Jr. . | |
| 2,516,852 | 8/1950 | Burry et al. . | |
| 2,575,681 | 11/1951 | Peters | 135/68 |
| 2,788,793 | 4/1957 | Abbott | 135/68 |
| 3,272,210 | 9/1966 | Boruvko | 135/72 X |
| 3,635,233 | 1/1972 | Robertson . | |
| 3,710,807 | 1/1973 | Ferry . | |
| 3,757,807 | 9/1973 | Manzo | 135/68 X |
| 4,121,605 | 10/1978 | Schmerl . | |
| 4,869,280 | 9/1989 | Ewing . | |
| 5,038,811 | 8/1991 | Gilmore | 135/71 |
| 5,329,954 | 7/1994 | Miyoshi | 135/68 X |

FOREIGN PATENT DOCUMENTS

| | | |
|---|---|---|
| 1070294 | 7/1954 | France . |
| 197027 | 9/1957 | Germany . |
| 663247 | 12/1951 | United Kingdom . |
| 840944 | 7/1960 | United Kingdom . |

*Primary Examiner*—Lanna Mai
*Attorney, Agent, or Firm*—Richard C. Litman

[57] ABSTRACT

A compactly collapsible, sectional Lofstrand-type crutch. The crutch features four sectional components: a stud section, a lower tubular member, and an upper tubular member, each telescopingly attached to one another along a longitudinal axis, and a tubular support member removably seated on the upper tubular member. The tubular support member features a support handle, which pivots upwardly into a recess defined within the tubular support member, thereby allowing the support handle to be subsumed into the recess and streamlining the folded assembly for storage. The tubular support member has a forearm sleeve for encircling the forearm of the user when the crutch is in use; when in a storage position, the forearm sleeve is pivotable to become aligned parallel and lateral to the tubular support member. The nested arrangement of the telescoping components shorten the overall length of the crutch to a convenient storage size. The tubular support member is easily removed from the upper tubular member at a point below the handle, and folded along side the nested telescoping components. A band to secure the completely nested arrangement and a clip for wearing the nested arrangement on a belt are also provided.

14 Claims, 5 Drawing Sheets

COLLAPSIBLE SECTIONAL LOFSTRAND-TYPE CRUTCH

CROSS-REFERENCE TO RELATED APPLICATION

This application claims the benefit of U.S. Provisional Patent Application Ser. No. 60/022,897, filed Aug. 1, 1996.

BACKGROUND OF THE INVENTION

1. Field of the Invention

The present invention relates to a collapsible, sectional crutch, particularly a compactly collapsible Lofstrand-type crutch.

2. Description of Related Art

The original Lofstrand crutch was patented on Oct. 15, 1945, U.S. Pat. No. 2,453,632 issued to A. R. Lofstrand, Jr. The crutch is well known to orthopedic appliance users and manufacturers. As used herein, a Lofstrand-type crutch should be understood to have the common combination of elements including telescoping tubular members for adjustable height of the crutch, an arm grip sleeve or split sleeve rockably attached to the upper end of the tubular members for encircling the forearm, and a hand grip attached at approximately a right angle to a tubular member below the split sleeve. The lower end of the tubular member is equipped with a reduced stud, usually having a rubberized boot. The tubular members and stud are typically secured in a telescoped position by internally disposed spring biased plugs, each plug received by a pair of holes opposingly defined in each of the telescoping members or stud and brought into registry with one another.

Most Lofstrand-type crutch users need the crutch primarily for ambulating; the user is usually quite able to stand and move short distances without imbalance even without the crutches. So typically, when the user wishes to manipulate an object with his or her hands while standing, or, when entering a confined space such as an automobile passenger compartment, the crutch Is put aside temporarily. Thus, whereas being helpful during ambulation, the crutch now becomes an awkward, cumbersome object which interferes with the undertaken activity.

Therefore, since the original Lofstrand patent, a plethora of structural variations have been developed in an effort to minimize the inconvenience of handling or storing the crutch when not in use. For example, U.S. Pat. No. 2,453,632 issued Aug. 1, 1950 to Burry et al. describes an improved crutch in which the forearm clamp is made of a flexible material with an improved opening so as to hang from the arm more freely and a protrusion on the handle which allows the crutch to be vertically hung on a table edge when not in use.

U.S. Pat. No. 3,635,233 issued Jan. 18, 1972, to Robertson describes a collapsible Lofstrand-type crutch. The crutch is tubular and segmented into a plurality of sections which are internally strung together on a tension cord, connected by a top pin to an upper segment and by a bottom pin to lower segment. The lower end of the clamp segment supporting the forearm clamp is conically formed and defines a shoulder, which configuration allows the clamp segment to be matingly nested onto the hollow hand grip member and to be easily disengaged for folding. German Patent No. 197027 issued Apr. 10, 1958 to Püaschner describes a similarly segmented tubular arrangement in which tension is provided by a spring. Another collapsible Lofstrand-type crutch similar to the Robertson crutch is shown in U.S. Pat. No. 4,869,280 issued Sep. 26, 1989 to Ewing, wherein a bungee cord passing through a series of sections and coupled by improved coupling means is described; a chuck or threaded collar for securing the tubular members in a fixed telescoped arrangement is also shown. A threaded collar for telescoping arrangements is also described in British Pat. Specification No. 840,944.

Other patents disclosing variations of the Lofstrand crutch found in the related art are directed at improvements only indirectly relevant to the present invention. British Pat. Specification 663,247 published Dec. 19, 1951 by Burke describes a crutch essentially identical to the original Lofstrand crutch. U.S. Pat. No. 3,710,807 issued Jan. 16, 1973 to Ferry describes a Lofstrand-type crutch having telescoping tubes which are arranged in an abutting fashion to provide a continuous, end-to-end columnar support between the handle and the lower end whereby no substantial strain is placed upon the fastening means.

French Brevet D'Invention published Jul. 21, 1954 by Gauthier describes a telescoping crutch having a wooden core stud section for receiving securing screws.

A walking cane assembly is described in U.S. Pat. No. 4,121,605 issued Oct. 24, 1978 to Schmerl in which the cane is provided with a stabilizing arm extendable laterally from the cane. The arm is pivotally attached and folds downward parallel and contiguous with the cane shaft for storage. However, the Schmerl patent teaches away from the use of the arm as a support, and is intended only for damping oscillations of a wobbly cane to help the user to stabilize his own movements. Use of such arm for weight support would prove dangerous to the user.

None of the above inventions and patents, taken either singularly or in combination, is seen to describe the instant invention as claimed. Thus a collapsible, sectional Lofstrand-type crutch solving the aforementioned storage problems is desired.

SUMMARY OF THE INVENTION

The present invention relates to a collapsible, sectional crutch, particularly a compactly collapsible Lofstrand-type crutch. Two embodiments are described. Each of embodiments of the collapsible, sectional crutch features four major sectional components: a stud section, a lower tubular member for telescopingly and adjustably receiving the stud section, an upper tubular member for telescopingly receiving the lower tubular member, and a tubular support member removably seated on the upper tubular member.

The tubular support member features a support handle which pivots upwardly into a recess defined within the tubular support member, thereby allowing the support handle to be subsumed into the recess and streamlining the folded assembly for storage. The tubular support member is also provided with a forearm sleeve, in the first embodiment comprising a pair of independently pivoting and locking arcuate bands, and in the second embodiment, a one-piece forearm sleeve. Each sleeve encircles the forearm of the user when the crutch is in use, yet when the crutch is in a storage position, each of the arcuate bands are pivotally brought into alignment, substantially parallel and lateral to the lengthwise axis of the tubular support member.

The upper tubular member telescopingly receives the lower tubular member, which in turn telescopingly receives the stud section, to allow a nested arrangement of the telescoping members within one another and thereby shorten the overall length of the crutch to a convenient storage size. The tubular support member is provided with a seating portion mating with the upper tubular member, to allow the tubular support member to be easily removed from the upper tubular member at a point below the handle and thereupon be folded along side the nested telescoping components. A band to secure the completely nested arrangement and a clip for wearing the nested arrangement on an article of clothing are also provided.

Accordingly, it is a principal object of the invention to provide a collapsible, compactly storable crutch.

It is another object of the invention to provide a Lofstrand-type crutch with a folding handle.

It is a further object of the invention to provide a Lofstrand-type crutch with a forearm sleeve which folds closely upon its support member.

Still another object of the invention is to provide a crutch with a clip for wearing the crutch in its collapsed state on the apparel of a user and banding means to maintain the collapsed state.

It is an object of the invention to provide improved elements and arrangements thereof in a collapsible, sectional crutch for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention relates to a collapsible, sectional crutch, particularly a compactly collapsible Lofstrand-type crutch.

Figure 1:
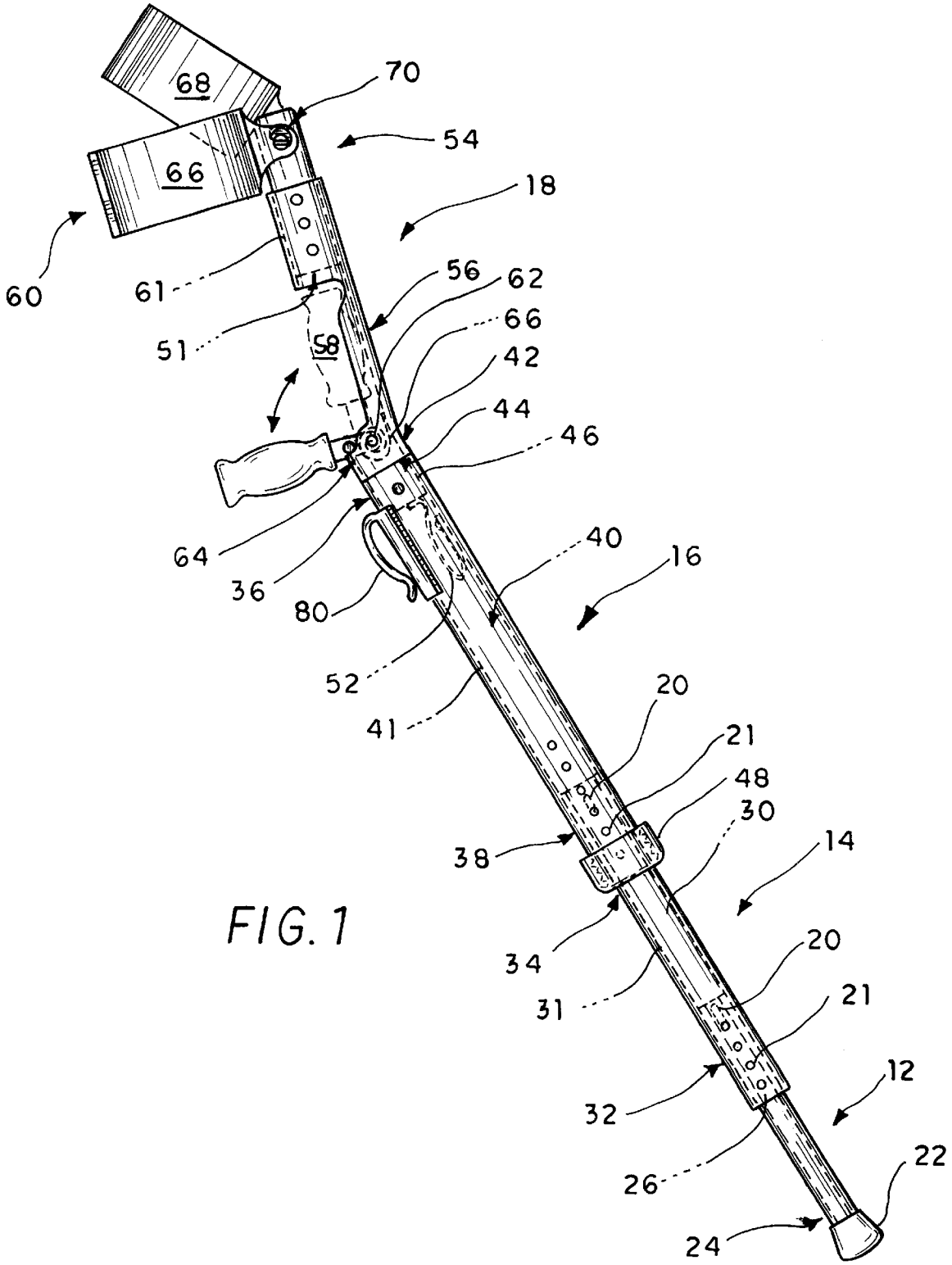
FIG. 1 is an elevational, side view of a first embodiment of a collapsible, sectional crutch according to the present invention.
Figure 5:
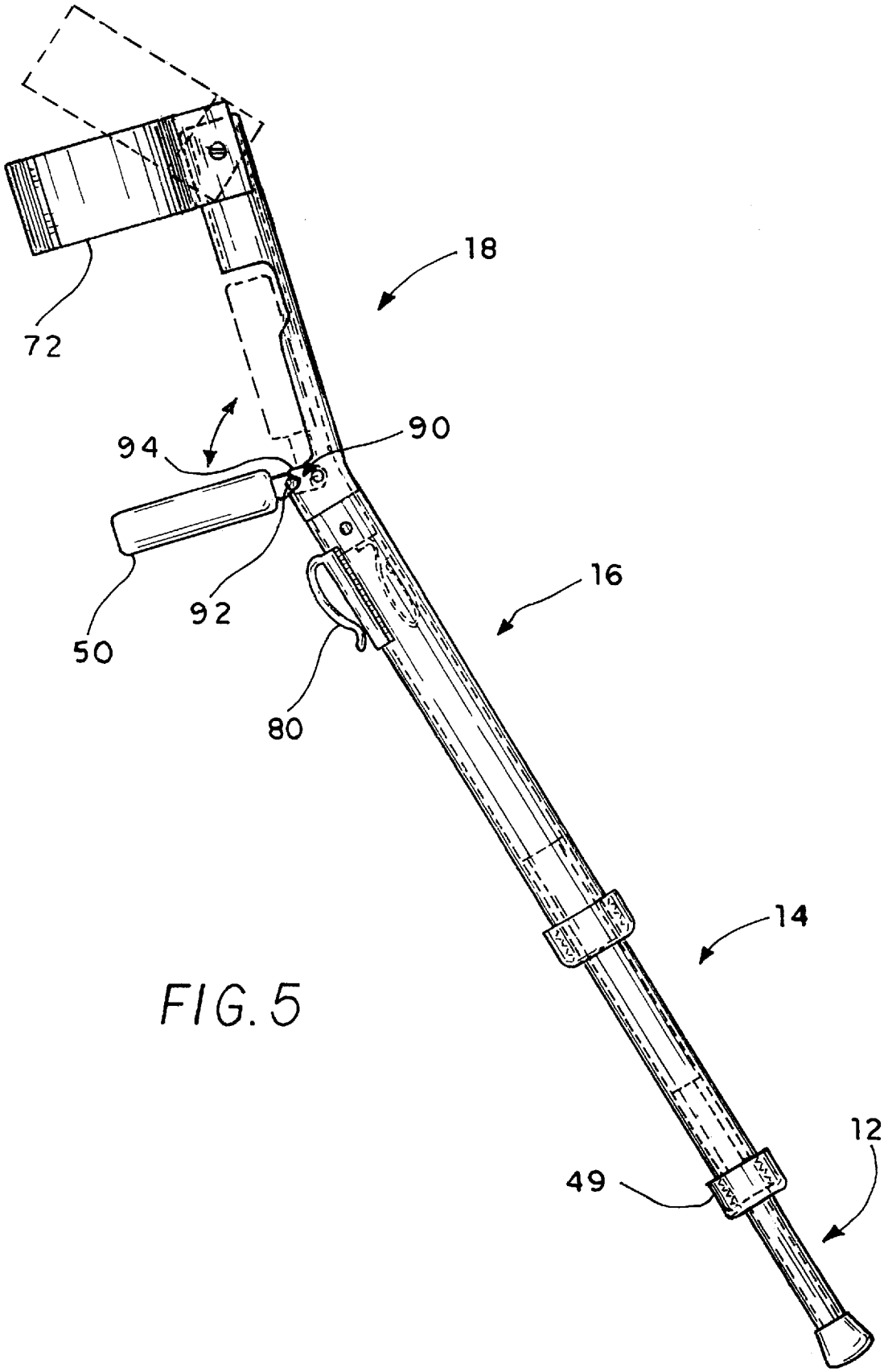
FIG. 5 is an elevational, side view of a second embodiment of a collapsible, sectional crutch according to the present invention, including an improved stud member and unitary forearm sleeve.

Referring first to FIG. 1 a first embodiment of the collapsible, sectional crutch 10 of according to the present invention is shown featuring four major sectional components: a stud section 12, a lower tubular member 14 for telescopingly and adjustably receiving the stud section, an upper tubular member 16 for telescopingly receiving the lower tubular member, and a tubular support member 18. FIG. 5 illustrates a second embodiment, comparable in its sectional components and function to the first embodiment, with minor modifications to the stud section 12 and tubular support member 18. Therefore, by comparing and referring to each of the Figures intermittently throughout, the sectional and telescoping nature of the four major components of each embodiment can be readily appreciated.

Figure 4:
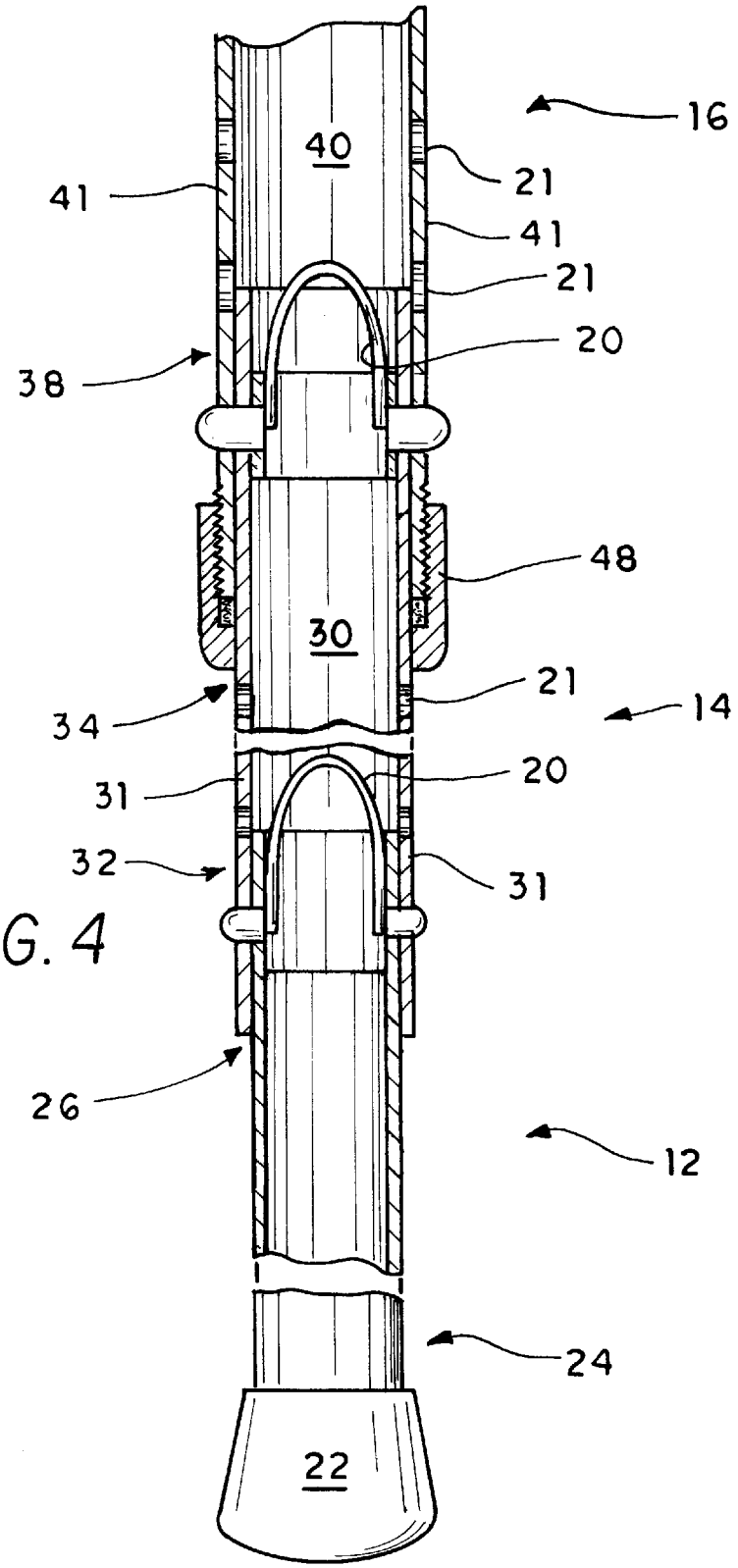
FIG. 4 is a partially fragmented, partial sectional view of the first embodiment of the collapsible, sectional crutch, enlarged to show detail of the telescoping lower and upper support members.

As can be best appreciated from both FIG. 1 and FIG. 4, the stud member 12 is elongated and may be a tube or rod. The stud section 12 further has a ground contacting end portion 24 and an upper end portion 26 which is received by the lower tubular member 14. The ground contacting end portion 24 may be provided with a boot 22 having anti-slip or frictionally engaging properties.

The lower tubular member 14 is elongated and has a stud receiving end portion 32 and a top end portion 34. The stud section 12 and the lower tubular member 14 are dimensioned and configured to receive a stud section 12 in a telescoping manner. In the two embodiments, the stud section 12 is received internally, in a lumen 30 of the lower tubular member 14 having a cylindrical wall 31 of slightly enlarged internal diameter over the external diameter of a cylindrical stud section 12. A telescoping longitudinal axis is thus defined passing through the length of the lumen 30 along the longitudinal, rotational axis of both the stud section 12 and the lower tubular member 14. This telescoping longitudinal axis is used as an imaginary reference line throughout the specification and passes continuously from the ground contacting end portion 24 along and throughout both the upper and lower tubular members 14,16.

The upper tubular member 16 has a first end 36 and a second end 38, and at the second end 38 receives the lower tubular member 14 in a telescoping manner along the same telescoping longitudinal axis. Again the lower tubular member 14 is received internally, in a lumen 40 of the upper tubular member 16 having a cylindrical wall 41 of slightly enlarged internal diameter over the external diameter of the cylindrical lower tubular member 14. The first end 36 of the upper tubular member is configured and dimensioned to receive the tubular support member 18, wherein the first end 36 is an open ended cylinder and the tubular support member 18 provides a matingly configured seating end portion 42.

In the first embodiment and referring to FIG. 2 and FIG. 3 for clarity, the tubular support member 18 is cylindrical and has a handle 50 and forearm sleeve 60 attached, discussed below in detail but characterizing the crutch 10 as a Lofstrand-type crutch in general appearance and use. The seating end portion 42 is configured to have an annular shoulder 44 extending inwardly and a narrowed cylindrical tubular plug 46 depending downwardly from the shoulder 44. The shoulder 44 removably and securely seats upon the wall 41 of the first end 36 of the upper tubular member 14, and the narrowed cylindrical tubular plug 46 is inserted into lumen 40. This configuration allows 1) the plug 46 to be firmly seated on the upper tubular member 16, 2) the weight bearing forces placed on the tubular support member 18 to be evenly distributed through the tubular support member 18 to the upper tubular member 16, and 3) the plug 46 to be easily removed so that the crutch 10 can be separated at a point below the handle 50.

Each of the sectional components 12,14,16,18 are secured to one another by a releasable securing means which, as shown in the first embodiment, comprises a commonly used spring plug 20 engaged within one of a series of apertures 21. The apertures are defined in the walls 41,31 of each tubular component 16,14, which apertures 21 can be brought into registry when the tubular components are telescoped. The plug portion of the spring plug 20 springs into two apertures in registry thereby securing the telescoping tubular components in a conventional manner. As can be readily appreciated from FIG. 4, in the lower tubular member 14, the apertures 21 and a spring plug 20 disposed internally to the stud section 12 permit adjustably selecting and securing the stud section 12 at one of a plurality of predetermined positions along the telescoping longitudinal axis. In the alternative, and as shown in FIG. 5, a preferred second embodiment may include an alternative releasable securing means which allows an infinitely variable adjustment. A standard chuck 48 or threaded collar attached to the second end 38 may be used in lieu of the aperture 21, which when tightened allows the telescoped relationship of the upper tubular member 16 and lower tubular member 14 to be temporarily fixed. Likewise, the telescoped relationship of the lower tubular member 14 and the stud section 12 can be temporarily fixed by a similarly functioning second chuck 49.

The lower tubular support 14 is also provided with a spring plug 20 in its top end portion 34. However, in the upper tubular member 14, an aperture 21 is only necessary at two positions: a fully projected position wherein the spring plug 20 engages the aperture 21 when substantially all of the lower tubular member 14 is extended along the telescoping longitudinal axis from the upper tubular member 16, and, as can be appreciated from FIG. 2, a fully received position wherein the spring plug 20 engages the aperture 21 when substantially all of the lower tubular member 14 is contained by the upper tubular member 16. The aperture 21 of the fully projected position may be placed proximate to the first end 36 of the upper tubular member; in the alternative, and as shown in the preferred embodiment of FIG. 5, a standard chuck 48 or threaded collar attached to the second end 38 may be used in lieu of the aperture 21 of the fully projected position. Likewise, the aperture 21 of the fully retracted position may be placed proximate to the second end 38 of the upper tubular member; a standard chuck 48 or threaded collar attached to the second end 38 may be used in lieu of, or in addition to, the aperture 21 of the fully retracted position. A number of apertures 21 may be added for additional adjustability, but which are not necessary for full extension and retraction of the tubular members for purposes of folding and storage of the crutch 10.

Figure 3:
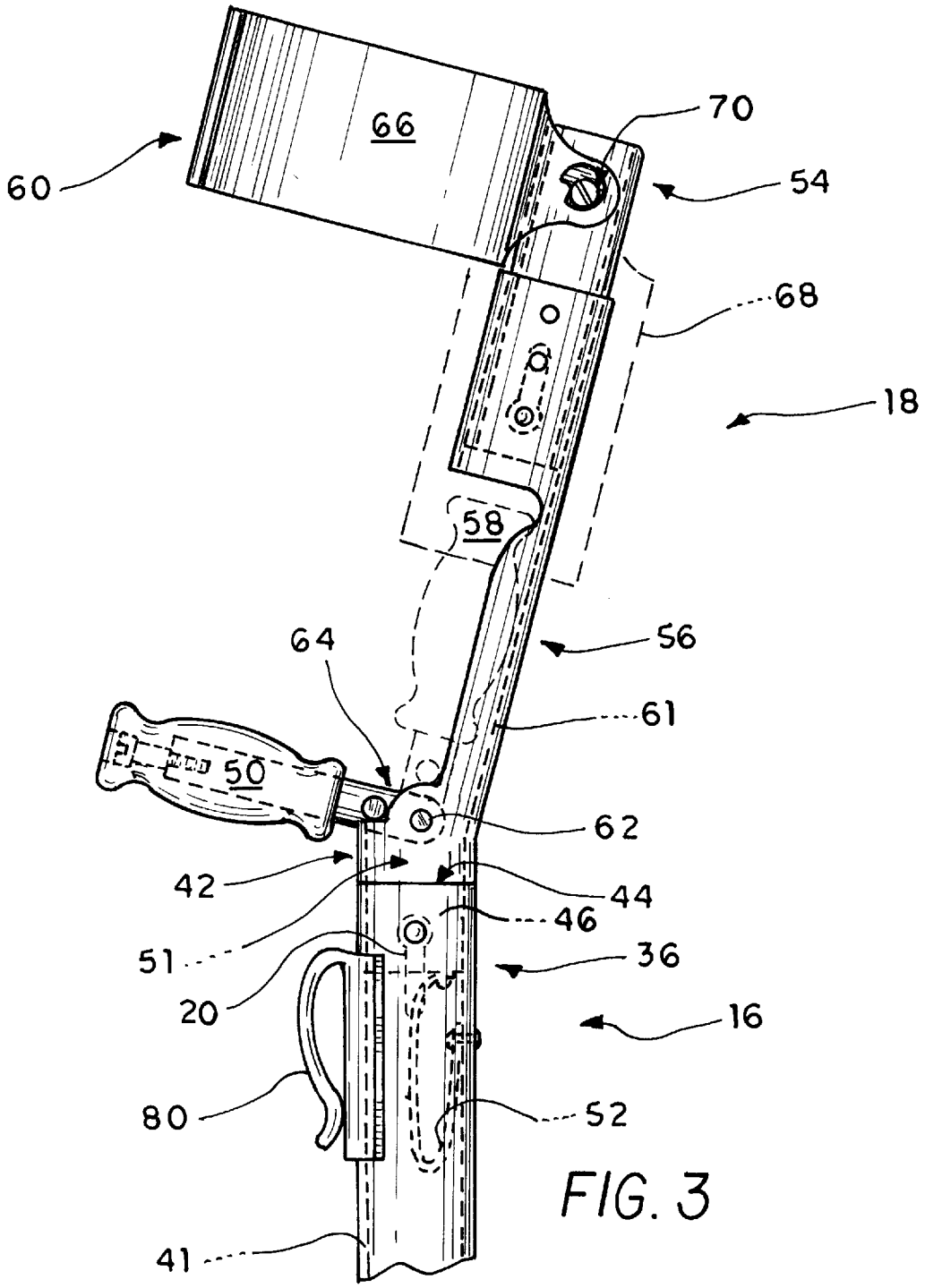
FIG. 3 is a partially fragmented view of the first embodiment of the collapsible, sectional crutch enlarged to show detail of the tubular support member.

Referring to FIG. 3, a spring plug 20, disposed within the plug 46 of the tubular support member 18, and aperture 21, proximate to the first end 36 of the upper tubular member 16, may also be provided to secure the components 18,16 together. The spring plug 20 will thus prevent the plug 46 of the tubular support member 18 from disengaging from within the lumen 40.

Figure 2:
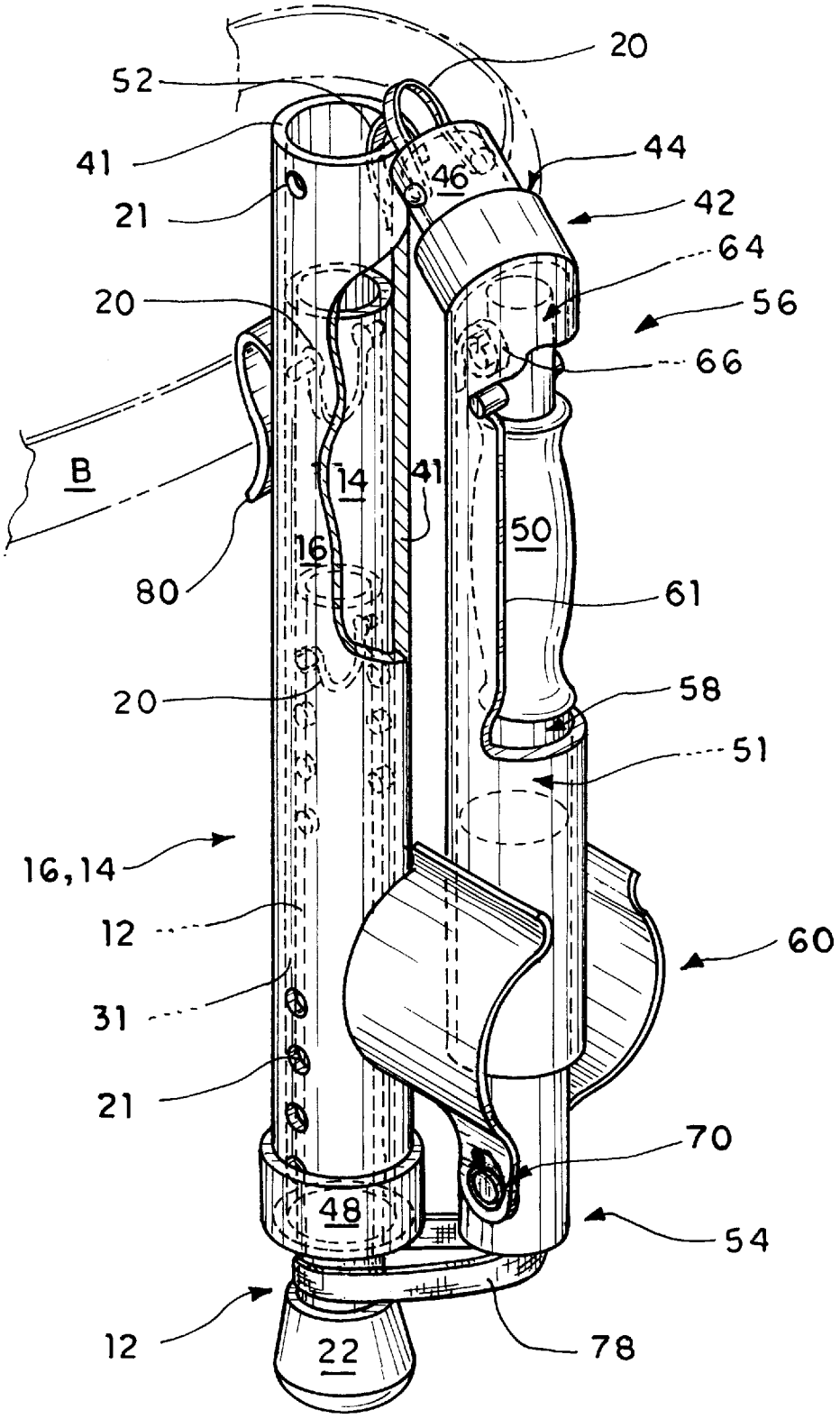
FIG. 2 is a perspective view of the first embodiment of the collapsible, sectional crutch shown in a folded state.

Referring now to FIG. 2, the crutch 10 is shown in its folded configuration. The stud section 12 may be first telescopingly received and secured by the lower tubular member 14 by pressing the spring plug 20 inwardly in the conventional manner to disengage the plug portion from the outer wall of the lower tubular member 14.

The lower tubular member 14 may in turn be telescopingly received by the upper tubular member 16 by rotationally loosening the chuck 48 of the preferred embodiment of FIG. 5, or pressing the spring plug 20 of the first embodiment inwardly in the conventional manner, to disengage the plug portion from the outer wall of the upper tubular member 14.

To further reduce the crutch 10 to the compact nesting assembly as shown in FIG. 2, the tubular support member 18 is removed from the upper tubular member 16 and folded parallel with the nested telescoping components 16,14,12. A flexible tether 52, as shown in FIG. 2 (and in phantom lines in FIG. 1), has an initial end attached internally within the lumen 41 of the upper tubular member 16 and a terminal end attached to the tubular support member 18, preferably internally to the plug 46. The tether 52 preferably has a resilient memory, and may be made of a bungee cord material or a coil spring. The tether 52 is of a length and construction to allow the tether 52 to retract inside the lumen 41 when the components 18,16 are assembled whereas, when the crutch is folded as shown in FIG. 2, the tether 52 is under tension to provide a resistive force against lateral separation of the tubular support member 18 from the upper tubular member 16. Moreover, a banding means 78 may be attached to the tubular support member for capturing and securing the ground contacting end portion 24 of the stud section 12 to restrain the nested telescoping components 16,14,12 in close proximity to the tubular support member 18. A simple flexible band attached at both ends to the bracing end portion 54 of the tubular support member 18 may be used to form a loop which can be slipped over the boot 22. Thus, the compact folded configuration of FIG. 2 may be maintained.

A major obstacle to compact storage, overcome by the present invention, is the perpendicularly fixed structure of the handle and forearm sleeve of a Lofstrand-type crutch. Referring now to both FIG. 2 and FIG. 3 intermittently, the assembly and structure of the handle 50 and the forearm sleeve 60 on the tubular support member 18 which permits the advantage of conveniently storing the folded crutch 10 and minimizing its space usage is apparent. By having the handle 50 pivotally attached to the tubular support member 18 by suitable pivoting means, the handle 50 can be entirely subsumed into a lumen 51 of the tubular support member 18 when the crutch 10 is in a folded configuration; thus, the folded configuration is dramatically streamlined. Moreover, unlike the present invention, a unitary split sleeve as known in the related art attached to a conventional Lofstrand-type crutch fails to permit rotation of the split sleeve lateral to the shaft of the crutch and parallel with its longitudinal axis. As discussed later in greater detail, the forearm sleeve 60 of the present invention is bipartite, each half allowed to swing downwardly lateral and entirely parallel to longitudinal axis of the tubular support member 18, thereby further minimizing the perpendicular protrusion the forearm sleeve 60 from the tubular support member 18. The arrangement of the forearm sleeve 60 and handle 50 effect a totally streamlined appearance and storage function.

In the preferred embodiment, tubular support member 18 has, in addition to the seating end portion 42, a bracing end portion 5,4 for attachment of the forearm sleeve 60 and a middle portion 56 for pivotal attachment of and receiving the support handle 50. The middle portion defines a recess 58 for receiving the support handle 50 in a closed state. The recess 58 is created by cutting an appropriately sized opening into the wall 61 of the tubular support member 18, thereby exposing the lumen 51. Obviously, the tubular support member 18 should be chosen to have a lumen 51 appropriately sized to accept most or all of the handle 50 both in width and length.

In order to permit the handle to be retracted into the recess 58 as well as provide adequate strength of the handle for supporting the weight of the user when the handle 50 is in an open state (as shown in FIG. 1 and FIG. 3), the support handle 50 is pivotally attached by a first pivoting means whereby the handle 50 acts as a cantilever in the open state. The first pivoting means of the preferred embodiment include a shaft or rod 62 affixed to the wall 61 of the middle portion 56 of the tubular support member 18 within the lumen 51 at a point proximate to the seating end portion 42. A bore is defined in a handle 50 at a point proximate to its pivot end portion 64 for concentric passage of the rod 62. The rod 62 and bore are positioned in the lumen 51 such that the handle 50 is permitted to pivot in an arc which ends within the confines of the recess 58. In a closed state, the handle 50 is positioned along the arc parallel and generally concentric to the longitudinal axis of the tubular support member 18. In an open state, the support handle 50 is positioned along the arc at approximately a right angle to the longitudinal axis of the tubular support member 18, wherein the handle 50 rests cantilevered upon the wall 61 of the middle portion 56. Thus, the full weight of the user may be brought to bear upon the cantilevered handle 50.

As can be seen in FIG. 5, a second variation of the handle 50, having a cylindrical grip, is shown, in which a locking mechanism 90 is provided for temporarily fixing the cantilevered handle 50 in an open or down position. The locking mechanism 90 of the second embodiment comprises a lip 94 defined by the tubular support member 18 lateral to each side of the recess 58 and an outwardly spring-biased detent 92, which permits inward compression of the detent 92 for passage beneath the lip 94. When fully cantilevered, the detent 92 is fully biased outwardly, and rests closely below the lip 94. The detent 92 and lip 94 thereby interfere with one another to prevent undesirable upward angular motion of the handle 50. The handle 50 can be retracted into a closed position by compressing the detent 92 flush with the surface of the handle and passing it under the lip 94. Although a lip and detent arrangement is shown as a preferred structure, any suitable locking means, having a comparable function to prevent undesired upward angular motion of the handle, known to an individual skilled in the art may be substituted.

To assist in automatically returning the handle to a closed state when the crutch 10 is not in use, automatic return means may also be included. Such means may include a spiral leaf spring 66 which ends are attached between the wall 61 of the tubular support member 18 and the handle 50, such that, when the handle 50 is pivoted to an open state, the leaf spring 66 is spirally compressed thus exerting a return force when the handle is released. Likewise, although a leaf spring arrangement is shown as a preferred structure, any suitable automatic return means, having a comparable function to return the handle in an upward angular motion into the recess, known to an individual skilled in the art may be substituted.

Turning attention now to the bracing end portion 54 of the tubular support member 18, it can be seen to have a pivotally attached rigid sleeve, i.e. means for substantially encircling the forearm of a user. Although a standard single split sleeve 72 as known in the related art may be used with the present invention, as shown in FIG. 5, using the conventional rocking means associated therewith prevents a complete minimizing of length of the present invention. In contrast to the bipartite arrangement of the first embodiment of FIG. 1, the conventional unitary split sleeve 72 is attached to a conventional Lofstrand-type crutch by a pivot assembly which is unitary with the split sleeve 72, and thus allows only extension of the split sleeve 72 to become collinear with the longitudinal axis of the tubular support member 18. Nevertheless, such conventional split sleeve 72 provides the invention with economy of manufacture and is therefore preferred.

Therefore, each component of the forearm sleeve of the first embodiment swings downwardly lateral and entirely parallel to longitudinal axis of the tubular support member 18, thereby further minimizing the perpendicular protrusion the forearm sleeve 60 from the tubular support member 18. The sleeve is formed by a pair of rigid arcuate bands 66,68 forming a split sleeve when paired, for substantially encircling the forearm of a user. Each of the pair 66,68 are individually, pivotally attached to the bracing end portion 54 by a second pivoting means 70. The second pivoting means 70 is positioned to permit each of the pair to be swung to a banding position, as suggested by FIG. 3, for substantially encircling the forearm, and to a folded position, as shown by FIG. 2, wherein each of the arcuate bands 66,68 are aligned substantially parallel with the lengthwise axis of the tubular support member 18. One such second pivoting means 70 is a ramped, self-locking and releasable spring mechanism, as known in the prior art, internally disposed within the tubular support member 18. Such a ramped spring-mechanism allows each arcuate band 66,68 to be brought into the banding position, whereupon the spring-mechanism locks into place. Upon depressing the spring-mechanism, the lock releases and allows and continuation of the rotation of an arcuate band.

Finally, the crutch 10 may include a clip 80 attached to one of either the tubular support member or the upper tubular member As shown in FIG. 2, the clip 80 may be used to attach to a piece of clothing, such as a belt B.

It is to be understood that the present invention is not limited to the embodiments described above, but encompasses any and all embodiments within the scope of the following claims.

I claim:

1. A collapsible, sectional crutch comprising:

a stud section having a ground contacting end portion and an upper end portion;

a lower tubular member, having a stud receiving end portion, a top end portion and defining a longitudinal axis therebetween, the stud section telescopingly attached to the lower tubular member along the longitudinal axis;

first means to said lower tubular member securing the stud section to said lower tubular member at one of a plurality of predetermined positions along the longitudinal axis;

an upper tubular member, having an first end and a second end, collinear with the longitudinal axis, the second end telescopingly attached to the top end portion of the lower tubular section along the longitudinal axis;

second means securing the lower tubular member to said upper tubular member at one of a plurality of predetermined positions along the longitudinal axis; and a tubular support member having a support handle;

a seating end portion configured to have a shoulder for removably and securely seating upon the first end of the upper tubular member;

a bracing end portion;

a middle portion, said middle portion defining a recess dimensioned to receive the support handle;

a first pivoting means pivotally attaching the support handle to the middle portion, wherein the first pivoting means permits the support handle to be pivoted between an open state and a closed state, wherein the support handle is received by the recess in the closed state and rests cantilevered upon the middle portion in the open state;

whereby the stud section, the lower tubular member, and the upper tubular member can be manually made to telescopingly retract into compact nesting assembly, and whereby further the tubular support member may be removed from the upper tubular member and folded lateral to the compact nesting assembly.

2. The collapsible, sectional crutch as defined in claim 1 wherein the bracing end portion has a sleeve means for substantially encircling the forearm of a user, the sleeve means pivotally attached to the bracing end portion.

3. The collapsible, sectional crutch as defined in claim 2 wherein the sleeve means is formed by a pair of rigid arcuate bands which when paired are adapted to substantially encircle the forearm of a user, and including a second pivoting means, each of the pair of rigid arcuate bands being individually pivotally attached to the bracing end portion by the second pivoting means, wherein the pivoting means permit each of the pair to be swung to a banding position for substantially encircling the forearm and to a folded position substantially parallel with the lengthwise axis of the tubular support member.

4. The collapsible, sectional crutch as defined in claim 3 further including securing means for temporarily preventing movement of the sleeve means when in a banding position.

5. The collapsible, sectional crutch as defined in claim 4 wherein the securing means is a ramped, self-locking and releasable spring mechanism internally disposed within the tubular support member.

6. The collapsible, sectional crutch as defined in claim 1 further including return means for automatically moving the support handle to a closed state.

7. The collapsible, sectional crutch as defined in claim 6 wherein the return means is a spring having opposing ends attached between the middle portion and the support handle.

8. The collapsible, sectional crutch as defined in claim 1 further including locking means for temporarily fixing the support handle in an open state.

9. The collapsible, sectional crutch as defined in claim 1 further including tethering means for tethering the upper tubular member to the tubular support member.

10. The collapsible, sectional crutch as defined in claim 9 wherein the tethering means has a resilient memory and is elongated and flexible.

11. The collapsible, sectional crutch as defined in claim 10 wherein the tethering means has an initial end and a terminal end and the initial end is attached within the upper tubular member and the terminal end is attached within the tubular support member.

12. The collapsible, sectional crutch as defined in claim 1 further including a banding means attached to the tubular support member for capturing and securing the ground contacting end portion in close proximity to the tubular support member when the compact nesting assembly is brought substantially parallel to the tubular support member.

13. The collapsible, sectional crutch as defined in claim 1 further including a clip attached to the tubular support member.

14. The collapsible, sectional crutch as defined in claim 1 further including a clip attached to the upper tubular member.

* * * * *